US006776670B2

(12) United States Patent
Süss

(10) Patent No.: US 6,776,670 B2
(45) Date of Patent: Aug. 17, 2004

(54) CLAMPING SPRING

(75) Inventor: Christian Süss, Strullendorf (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 10/200,421

(22) Filed: Jul. 22, 2002

(65) Prior Publication Data

US 2003/0017754 A1 Jan. 23, 2003

(30) Foreign Application Priority Data

Jul. 20, 2001 (DE) ..... 101 35 597

(51) Int. Cl.[7] ..... H01R 4/48
(52) U.S. Cl. ..... 439/834
(58) Field of Search ..... 439/834, 828, 439/835, 839

(56) References Cited

U.S. PATENT DOCUMENTS 4,026,013 A 5/1977 Hughes
2003/0057621 A1 3/2003 Pedrinelli et al.

FOREIGN PATENT DOCUMENTS

| | | | |
|---|---|---|---|
| DE | 76.09 673 | | 7/1976 |
| DE | 76 09 673 | | 7/1976 |
| DE | 31 30 318 | A1 | 2/1983 |
| DE | 34 47 135 | A1 | 5/1986 |
| DE | 295 14 509 | U1 | 12/1995 |
| DE | 296 08 178 | U1 | 9/1996 |
| DE | 196 46 103 | C1 | 3/1998 |
| DE | 197 15 971 | C1 | 5/1998 |
| DE | 198 10 310 | C1 | 7/1999 |
| EP | 0 303 818 | B1 | 2/1989 |
| FR | 2 566 967 | A1 | 1/1986 |
| FR | 2 815 177 | A1 | 4/2002 |
| SU | 752568 | * | 8/1980 |

* cited by examiner

*Primary Examiner*—Gary F Paumen
(74) *Attorney, Agent, or Firm*—Laurence A. Grenberg; Werner H. Stemer; Ralph E. Locher

(57) ABSTRACT

A clamping spring for a spring terminal includes a fixed leg and an angular spring leg disposed resiliently on the fixed leg. An auxiliary spring leg is disposed resiliently on the fixed leg and acts with its spring force on the spring leg.

8 Claims, 2 Drawing Sheets

CLAMPING SPRING

BACKGROUND OF THE INVENTION

Field of the Invention

The present invention relates to a clamping spring for a spring terminal, having a fixed leg and an angular spring leg located resiliently on the fixed leg. Such clamping springs, which are also referred to as "cage springs", are used in screwless terminals that are known, for example, from European Patent 0 303 818 B1.

In the technical field of terminals and connectors, as in many technical fields, there is a trend toward miniaturization of components. That means that there is always only limited installation space available inside a terminal for the clamping spring. That limited installation space conflicts with the necessity of providing larger clamping springs for contacting conductors having large conductor cross sections. In other words, the installation space for the clamping spring in the terminal is the bottleneck factor for the maximum connectable conductor cross section.

SUMMARY OF THE INVENTION

It is accordingly an object of the invention to provide a clamping spring for a spring terminal which overcomes the hereinafore-mentioned disadvantages of the heretofore-known devices of this general type in such a way that conductors with large conductor cross sections can also be clamped in the spring.

With the foregoing and other objects in view there is provided, in accordance with the invention, a clamping spring for a spring terminal, comprising a fixed leg, an angular spring leg disposed resiliently on the fixed leg and an auxiliary spring leg disposed resiliently on the fixed leg. The auxiliary spring leg has a spring force acting on the spring leg. The clamping spring is formed of one bent piece.

The invention is based on the fundamental concept of increasing the effective spring force of the clamping spring in order for it to be possible, as a result, to exert a greater clamping force on the conductor. Due to this greater clamping force, a comparatively greater conductor cross section can be clamped in a clamping spring of the same size and the same bending stress. Conversely, this means a saving in terms of the size of the clamping spring. Therefore, in relation to conventional clamping springs, the clamping spring according to the invention has not only a spring leg which serves for clamping the conductor and is located resiliently on a fixed leg, but also an additional auxiliary spring leg which increases, and ideally virtually doubles, the sum of the spring forces exerted by the clamping spring. This structure of a bent component, preferably a one-piece spring-steel bent component is simple in terms of manufacture and thus advantageous and contributes to reducing production costs.

The following developments of the invention in some cases are advantageous and in some cases are inventive in themselves as well.

In accordance with another feature of the invention, there is provided a spring excursion limiter formed on the auxiliary spring leg. The spring excursion limiter prevents over-pressing of the clamping spring during the connection operation. This is relevant in terms of safety, because over-pressing of the clamping spring during contacting may go unnoticed by the operator. In that case, the contact between the conductor and the clamping spring may initially appear to be made but subsequently fail, without the faulty contacting being identifiable from outside as the reason for the failure.

In accordance with a further feature of the invention, the fixed leg and the spring leg surround a spring interior, and the auxiliary spring leg is disposed in the spring interior. Accordingly, the invention makes use of the fact that, in known clamping springs, the fixed leg and the spring leg surround a spring interior which, in the final mounted state of the clamping spring, lies idle in an effectively wasted manner. According to the invention, this spring interior that conventionally lies idle in an effectively wasted manner is used as the installation space for the auxiliary spring leg. In this way, the auxiliary spring leg can be accommodated without any difficulties while retaining exactly the same installation space as for the clamping spring according to the state of the art.

In accordance with an added feature of the invention, the spring leg on one hand and the auxiliary spring leg on the other hand are formed on two different free ends of the fixed leg. Therefore, in the event of failure of one of the two spring legs, the other spring leg in each case can nevertheless completely retain its ability to function.

In a first preferred embodiment of the invention, the auxiliary spring leg has a geometry adapted to the geometry of the clamping spring. Therefore, in accordance with an additional feature of the invention, the auxiliary spring leg is substantially V-shaped and has a spring auxiliary bar lying snugly next to a partial region of the spring leg like a skeleton and a base auxiliary bar disposed at the fixed leg. In accordance with yet another feature of the invention, there is provided a bulge bent out toward the spring leg and disposed between the fixed leg and the base auxiliary bar, as a spring excursion limiter.

Another embodiment of the invention is regarded as advantageous in particular with regard to its spring characteristics. Therefore, in accordance with yet a further feature of the invention, the auxiliary spring leg has a free end facing away from the fixed leg and bearing against the spring leg, and the auxiliary spring leg and the spring leg move in opposite directions. In accordance with a concomitant feature of the invention, the free end of the auxiliary spring leg bears against the spring leg as a slide guide and has a rounding, and the free end has a bent-off region forming an extension of the rounding acting as a spring excursion limiter.

Other features which are considered as characteristic for the invention are set forth in the appended claims.

Although the invention is illustrated and described herein as embodied in a clamping spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
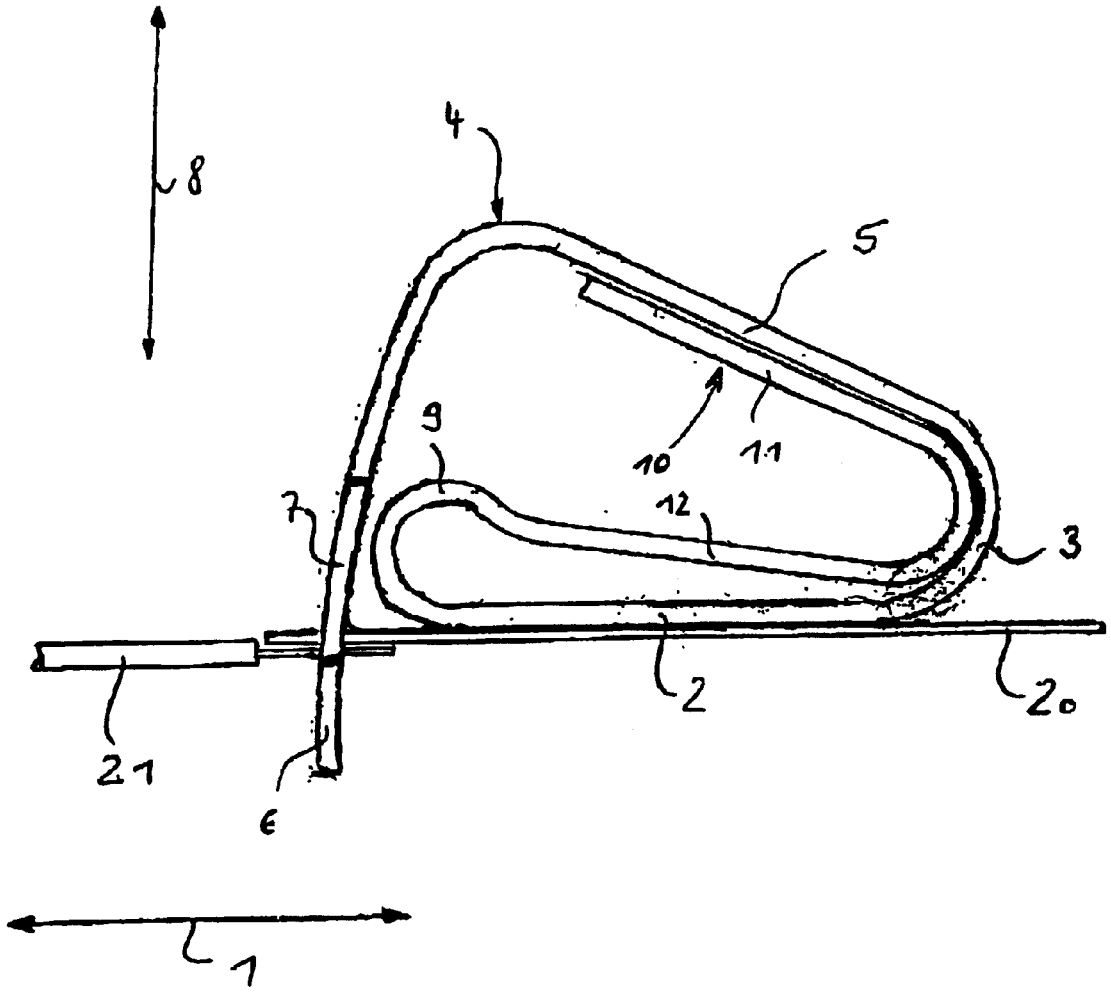
FIG. 1 is a diagrammatic, side-elevational view of an illustrative embodiment of a clamping spring according to the invention.

Referring now to the figures of the drawings in detail and first, particularly, to FIG. 1 thereof, there is seen a clamping spring which has a fixed leg 2 extending in the horizontal direction 1. The fixed leg 2 runs into an outward bend 3 to which an angular spring leg 4 is resiliently fixed. The spring leg 4 adjoining the outward bend 3 is bent in a somewhat L-shaped manner and is, as it were, made up of a base part 5 and a connection part 6 bent off from the base part 5. A conductor insertion opening 7 illustrated diagrammatically in FIG. 1 passes through the connection part 6.

A conductor rail 20 indicated diagrammatically in FIG. 1 is disposed below the fixed leg 2 of the clamping spring in the vertical direction 8 extending at right angles to the horizontal direction 1. Therefore, in the illustrative embodiment shown in FIG. 1, the fixed leg 2 lies on the conductor rail 20. The spring leg 4 is pressed down in the vertical direction 8 toward the fixed leg 2 to operate the clamping spring which, in the illustrative embodiment according to FIG. 1, is in the form of a cage strain spring. As a result, the conductor insertion opening 7 moves past the fixed leg 2 and the conductor rail 20 in the vertical direction 8, so that a conductor 21 can be inserted into the conductor insertion opening 7 in the horizontal direction 1. This is done in such a way that the conductor 21 touches the underside of the conductor rail 20 and bears against the underside of the conductor rail 20 in a contacting manner. By virtue of the release and springing back of the spring leg 4, the conductor 21 is pressed firmly against the underside of the conductor rail 20 in this described position. As a result, a contact pressure necessary for functioning of the clamping spring is achieved.

A bulge 9 is bent outward toward the spring leg 4 at a free end of the fixed leg 2, which faces away from the outward bend 3. An auxiliary spring leg 10 adjoins the bulge 9. The auxiliary spring leg 10 is formed of a spring auxiliary bar 11 lying snugly next to the base part 5 of the spring leg 4 and of a base auxiliary bar 12 disposed between the spring auxiliary bar 11 and the bulge 9. In this connection, the bulge 9 protrudes in the vertical direction 8 toward the spring leg 4 relative to the base auxiliary bar 12 and in this way forms a spring excursion limiter for the spring leg 4. In the illustrative embodiment shown in FIG. 1, the spring excursion of the clamping spring is limited by the spring leg 4, in a maximum deflected state, lying flush on the bulge 9. In this way, the bulge 9 prevents further pressing of the spring leg 4 in the vertical direction 8.

It can be seen from the view in FIG. 1 that the auxiliary spring leg 10 virtually duplicates the base part 5 of the spring leg 4 and the fixed leg 2. This is done to increase, and preferably double, the effective spring force of the clamping spring. On one hand, in comparison to a clamping spring according to the state of the art without an auxiliary spring leg 10, it is possible to produce double the spring force with the same deflection of the spring leg 4 and consequently the same bending stress of the clamping spring. If, on the other hand, a clamping spring of double the material thickness were used, this spring would, at the same deflection, either break or at least be irreversibly deformed.

Figure 2:
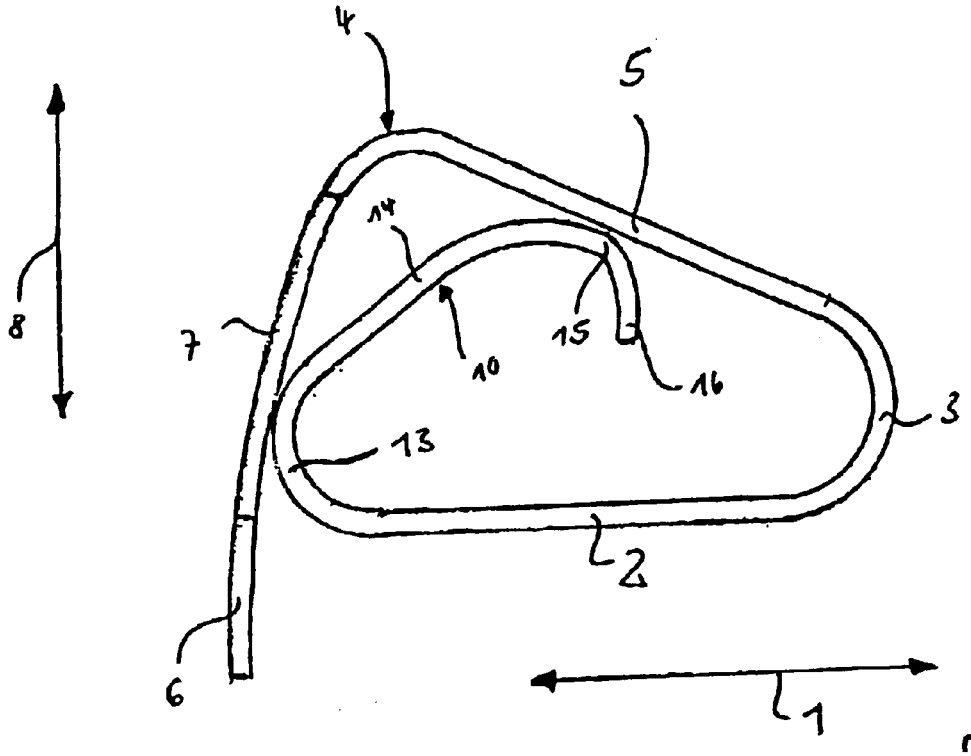
FIG. 2 is a side-elevational view of another illustrative embodiment, differing from that in FIG. 1, of the clamping spring according to the invention in an unloaded state.

The second illustrative embodiment shown in FIG. 2 likewise has a fixed leg 2 extending in the horizontal direction 1. This illustrative embodiment shown in FIG. 2 is identical with the illustrative embodiment shown in FIG. 1 with regard to the spring leg 4 as well. In the illustrative embodiment according to FIG. 2, the auxiliary spring leg 10 is connected to the fixed leg 2 through a bend 13 lying opposite the outward bend 3 in the horizontal direction 1. Adjoining the bend 13 is a spring bar 14 which in turn has a rounding 15 at its free end. An extension 16 projecting in the vertical direction 8 adjoins the rounding 15.

Figure 3:
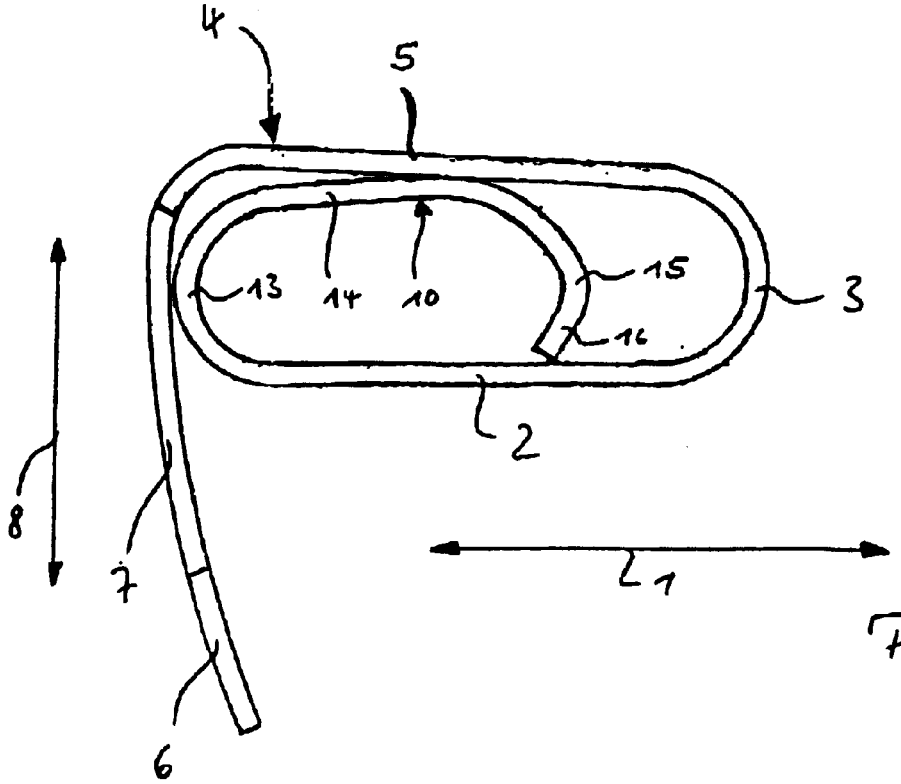
FIG. 3 is a side-elevational view of the clamping spring illustrated in FIG. 2 in a completely deflected state.

The way that this illustrative embodiment according to FIG. 2 functions is shown by the overall view afforded by FIG. 2 on one hand and FIG. 3 on the other hand. If the clamping spring which is illustrated in a completely unloaded state in FIG. 2 is deflected, both the spring leg 4 and the auxiliary spring leg 10 are deflected, so that the base part 5 of the spring leg 4 on one hand and the spring bar 14 of the auxiliary spring leg 10 on the other hand, move into a virtually horizontal position extending in the horizontal direction 1. In this connection, it can be seen that the point of contact between the spring bar 14 and the spring leg 4 is always situated roughly in the vicinity of the center of the base part 5 of the spring leg 4. In other words, therefore this point of contact cannot shift into the vicinity of a bend, for example the outward bend 3. Since the point of contact between the spring leg 4 and the auxiliary spring leg 10 is consequently virtually constant, a lever arm acting between the spring leg 4 and the auxiliary spring leg 10 is always virtually constant. In the completely deflected state according to FIG. 3, the extension 16 acts as a spring excursion limiter by lying with its end side on the fixed leg 2 and in this way preventing further deflection of the spring leg 4 in the vertical direction 8.

The two illustrative embodiments consequently differ in that the movement of the spring leg 4 and of the auxiliary spring leg 10 is in the same direction in the illustrative embodiment according to FIG. 1. However, the movement directions of the spring leg 4 and of the auxiliary spring leg 10 in the illustrative embodiment shown in FIG. 2 and FIG. 3 are opposite.

I claim:

1. A clamping spring for a spring terminal, comprising:

a fixed leg;

an angular spring leg disposed resiliently on said fixed leg; and an auxiliary spring leg disposed resiliently on said fixed leg, said auxiliary spring leg having a spring force acting on said angular spring leg;

said fixed leg, said angular spring leg and said auxiliary spring leg being formed of one bent piece.

2. The clamping spring according to claim 1, which further comprises a spring excursion limiter formed on said auxiliary spring leg.

3. The clamping spring according to claim 1, wherein said fixed leg and said angular spring leg surround a spring interior, and said auxiliary spring leg is disposed in said spring interior.

4. The clamping spring according to claim 1, wherein said fixed leg has two ends facing away from one another, and said angular spring leg and said auxiliary spring leg are each formed on a respective one of said two ends.

5. The clamping spring according to claim 1, wherein said auxiliary spring leg is substantially V-shaped and has a spring auxiliary bar lying snugly next to a partial region of said angular spring leg like a skeleton and a base auxiliary bar disposed at said fixed leg.

6. The clamping spring according to claim 5, which further comprises a bulge bent out toward said angular spring leg and disposed between said fixed leg and said base auxiliary bar, as a spring excursion limiter.

7. The clamping spring according to claim 1, wherein said auxiliary spring leg has a free end facing away from said fixed leg and bearing against said angular spring leg, and said auxiliary spring leg and said angular spring leg move in opposite directions.

8. The clamping spring according to claim 7, wherein said free end of said auxiliary spring leg bears against said angular spring leg as a slide guide and has a rounding, and said free end has a bent-off region forming an extension of said rounding acting as a spring excursion limiter.

* * * * *